United States Patent [19]

Greenfield

[11] 4,112,645

[45] Sep. 12, 1978

[54] PORTHOLE ARRANGEMENT

[76] Inventor: Frederick Dale Greenfield, 25028 S. Vermont, Harbor City, Calif. 90710

[21] Appl. No.: 778,095

[22] Filed: Mar. 16, 1977

[51] Int. Cl.[2] ..... E06B 1/14

[52] U.S. Cl. ..... 52/304; 49/504; 49/476; 52/209

[58] Field of Search ..... 52/209, 212, 302–305; 49/408, 476, 504; 114/173, 177, 178, 211

[56] References Cited

U.S. PATENT DOCUMENTS

| | | | |
|---|---|---|---|
| 2,570,336 | 10/1951 | Fouts | 52/209 |
| 2,895,184 | 7/1959 | O'Connor | 52/304 X |
| 3,555,736 | 1/1971 | Koch | 52/303 X |
| 3,769,769 | 11/1973 | Kohl | 52/212 |

*Primary Examiner*—J. Karl Bell

*Attorney, Agent, or Firm*—Don B. Finkelstein

[57] ABSTRACT

An improved porthole arrangement provided with a plurality of water drain holes to drain rain water or spray which may accumulate in the porthole arrangement and the porthole arrangement is also provided with a rain shield which allows the window of the porthole to be maintained in an open position for ventilation purposes and prevents the splashing of water into the interior.

16 Claims, 7 Drawing Figures

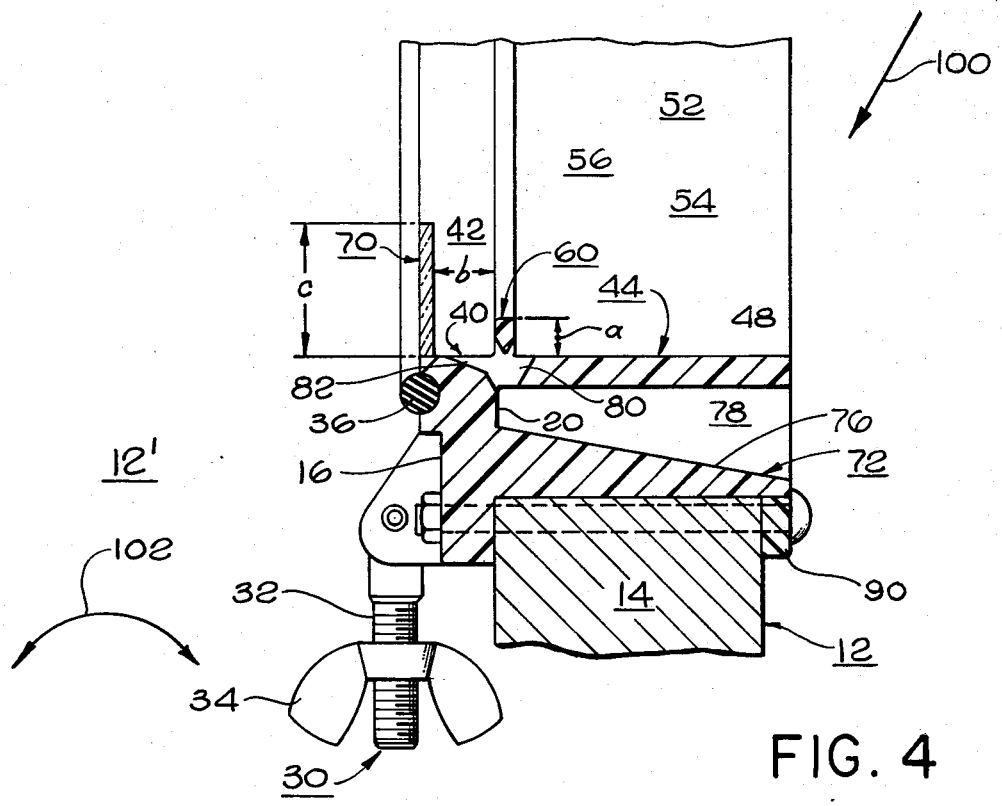
FIG. 4
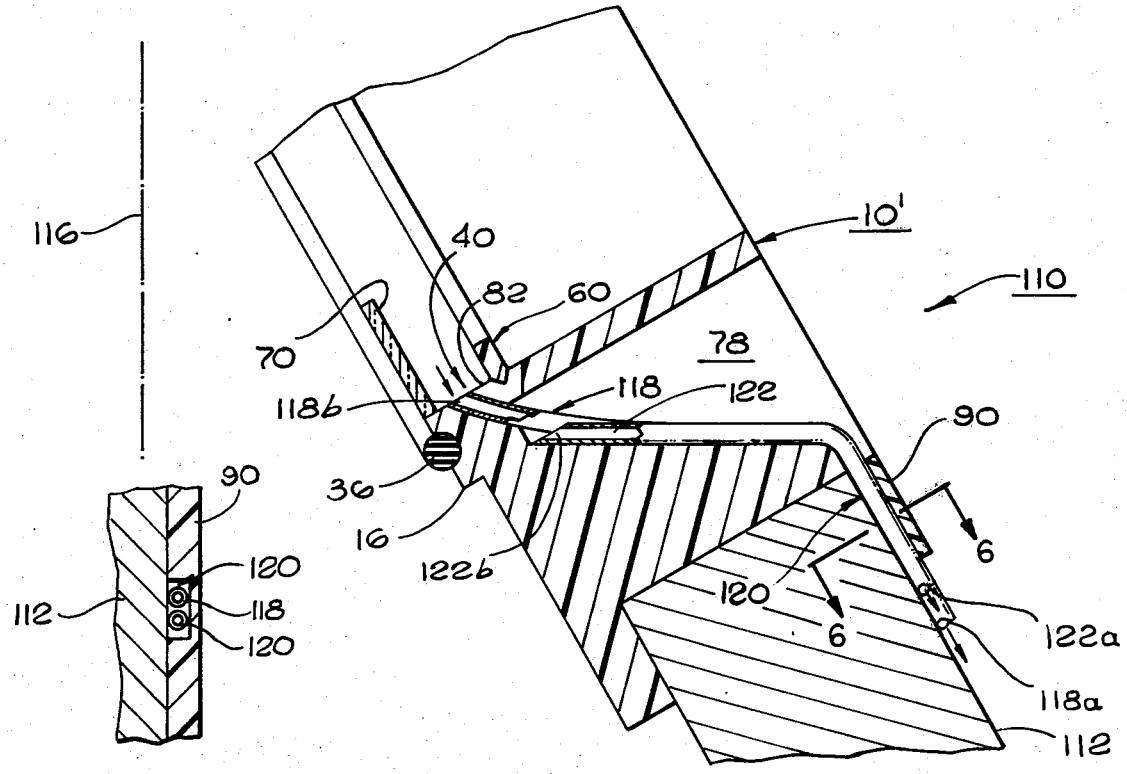
FIG. 6
FIG. 5

PORTHOLE ARRANGEMENT

BACKGROUND OF THE INVENTION

1. Field of the Invention

This invention relates to the porthole art and more particularly through an improved porthole arrangement particularly adapted for utilization on boats.

2. Description of the Prior Art

Porthole arrangements have long been utilized on boats. However, there has also recently been an increase in the utilization of porthole type arrangements on such things as recreational vehicles, motor homes, mini-motor homes and vans. The improved porthole arrangements described herein, while described as utilized on a boat, may equally well be utilized in any other type of structure, mobile or stationary, where the particular features of the improved porthole arrangement are found desirable.

In boat applications it is often desirable to maintain the porthole in an open position in order to provide ventilation to the interior of the boat. However, during rain storms and/or when the boat is rolling or pitching due to wind or wave action, it has been found that with conventional porthole arrangements water tends both to accumulate within the porthole structure and, depending upon the amount, spill into the interior of the boat and also that rain tends to splash upon the porthole structure and, with the porthole open, splash into the interior of the boat. The splashing of the rain water into the interior of the boat is aggravated when the boat is also rolling since periodically a greater projected area of the open porthole will be exposed to the rain.

Further in many instances, vehicles such as boats are often left unattended for extended periods of time with the window thereof in a closed position. In such instances, water, from rain, condensation, spray, or the like, tends to accumulate in the porthole. Consequently, when the window is thereafter opened, such accumulated water often flows into the interior of the vehicle.

Additionally, in many boats the walls of a cabin thereon are angled upwardly so that the installation of a porthole therein increases the projected area thereof exposed to rain as well as increasing the amount of water which may accumulate therein.

Certain prior art structures have attempted to alleviate this condition. One such device as shown in U.S. Pat. No. 3,503,169 shows a self-draining window sill but is not particularly adaptable, because of its complex nature, to many applications and cannot be conveniently or economically fabricated.

U.S. Pat. No. 2,791,011 shows another version of a drain arrangement from windows, glass doors, and the like but does not provide either adequate draining of all the water which may accumulate or any protection against the splash up of rain water into the interior of the structure upon which such a device is mounted.

Many other prior art patents such as U.S. Pat. Nos. 719,416, 1,752,794, 1,763,464, 2,377,863, 1,605,388, 1,771,514, 591,707, 1,750,695, 1,648,445, 960,926, and 2,348,886, all show various arrangements for similar devices but none are proven to be completely satisfactory for draining the accumulated water as well as preventing splash up of rain water into the interior of the structure.

U.S. Pat. No. 3,636,660 shows another type of window draining arrangement with a drainage system provided therein but which is not particularly adapted to prevent the splash up of water into the interior of the structure.

Accordingly, it has long been desirable to provide a porthole arrangement, particularly useful on boats, in which water is prevented from accumulating in the porthole structure and spilling into the interior of the boat and also rain water is prevented from splashing up and into the interior of the boat, thus allowing the porthole to be maintained in an open position for desired ventilation without taking on board large amounts of water. It will be appreciated, of course, that in boat applications, particularly, where the boat is rolling to such a degree that the lower edge of the porthole will be submerged for any period of time below the water level due to a combination of the roll and wave and/or wind action, the porthole must be maintained closed in order to prevent flooding of the interior. However, where the porthole is sufficiently above the expected water level it has been found that the porthole constructed in accordance with the principles of the present invention may be maintained in an open position over a wider range of roll angles and/or rain or spray angles than portholes heretofore available.

SUMMARY OF THE INVENTION

Accordingly, it is the object of the present invention to provide improved porthole arrangements.

It is another object of the present invention to provide an improved porthole arrangement particularly adapted for boats.

It is another object of the present invention to provide an improved porthole arrangement which may be maintained in an open position over a comparatively wide range of roll angles and wind and/or spray angles impinging upon the boat.

It is still another object of the present invention to provide an improved porthole arrangement that is self-draining to prevent the accumulation of water thereon.

It is yet another object of the present invention to provide an improved porthole arrangement in which rain is prevented from splashing up and into the interior of the boat through the open porthole.

The above and other objects of the present invention are achieved, according to a preferred embodiment thereof, by providing an interior frame means having a top, bottom and opposed side walls. A through hull fitting means is coupled to the interior frame means and, in preferred embodiments of the present invention may be unitarily formed therewith. The through hull fitting means has top, bottom and opposed side walls aligned with the corresponding top, bottom and opposed side walls of the interior frame means. Both the interior frame means and the through hull fitting means have first walls that define aligned appertures therethrough.

A screen bracket means which comprises an upstanding rim means is coupled to the first walls of the through hull fitting and extends around the apperture and projects into the apperture a first preselected distance. The screen bracket means is spaced from the interior surface of the interior frame means.

A transparent rain shield means is coupled to the interior surface of the interior frame means along the bottom wall thereof and projects upwardly a preselected distance into the apperture therethrough and the distance that the rain shield projects upwardly is greater than the height of the screen bracket means.

The screen bracket means is provided with a plurality of drain apperture walls therethrough to provide communication between the region located between the rain shield means and the screen bracket means and regions external the screen bracket means along the bottom wall of the through hull fitting.

A U-shaped channel means is coupled to the bottom wall of the through hull fitting and extends therebelow and the bottom wall of each of the through hull fitting and interior frame means are provided with water passage means extending into the U-shaped channel. The water passage means allows water on the bottom walls of the interior frame means in regions between the rain shield means and the screen bracket means to drain into the U-shaped channel due to gravity flow and, similarly, the water passage in the bottom wall of the through hull fitting allows water to drain therethrough and into the U-shaped channel by gravity flow. Thus, water is prevented from accumulating along the bottom walls of either the through hull fitting or the interior frame means and is prevented from being trapped in regions between the rain shield and the screen bracket.

The rain shield prevents rain or other spray from bouncing up after striking a surface of the porthole arrangement and through the apperture and into the interior of the structure to which the porthole arrangement is attached. Thus, the window, which is pivotally attached to the interior frame means of the interior surface thereof, may be maintained in an open position over a wider range of roll angles of the boat to which the porthole arrangement is attached and a wider range of downwardly directed rain fall that has heretofore been available in prior art portholes. Similarly, the drain apperture walls in the screen bracket means also allows water to drain from the region between the rain shield and the screen bracket means and into the through hull fitting along the bottom wall thereof for eventual draining overboard. However, in applications of the present invention wherein the porthole is installed in an upwardly angled cabin wall of a boat, additional drain tubes may be installed to provide a vertically lower water outlet from, for example, the region between the screen bracket and rain shield (and/or window) and the U-shaped channel itself. Such an embodiment allows utilization of the same basic porthole structure in all applications while still providing the advantages of the present invention. It will be appreciated, of course, that structures such as buildings or mobile vehicles on land are generally not subjected to the wide range of roll angles and/or pitch angles while vehicles such as boats or aircraft, of course, are subjected to a wide range of roll angles and pitch angles. Thus, while the present invention may be utilized in any type of structure where desired, it has particular utility in, for example, boats where the combination of a spray and/or wave action water together with rain and accompanied by a wide range of roll and/or pitch angles subjects the porthole arrangement to much more incident water thereon than in stationary or land based vehicles.

BRIEF DESCRIPTION OF THE DRAWINGS

FIG. 4 is a sectional view taken along the line 4—4 of FIG. 2;

FIG. 5 is a sectional view similar to FIG. 4 of another embodiment of the present invention;

FIG. 6 is a sectional view along the line 6—6 of FIG. 5; and

DESCRIPTION OF THE PREFERRED EMBODIMENTS

Figure 1:
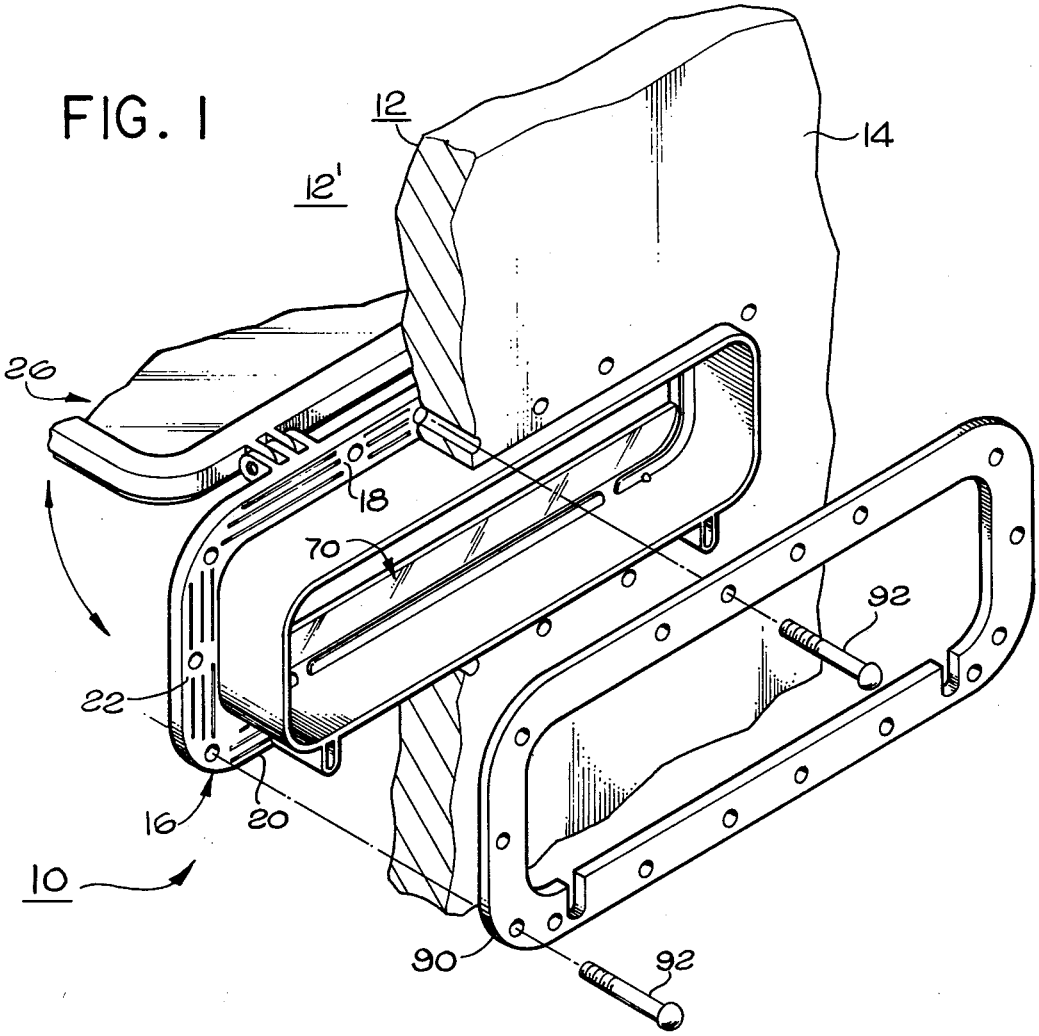
FIG. 1 is a perspective view of one embodiment of the present invention.

Referring now to the drawings there is illustrated a preferred embodiment generally designated 10 of the present invention. It will be appreciated that the description of the utilization of the preferred embodiment 10 is in connection with a boat. However, such description is for illustrative purposes only to set forth the best mode contemplated for carrying out the invention and is not to be interpreted as a limitation upon the invention or the utilization thereof.

The embodiment 10 is utilized on a boat 12 and in particular on the hull 14 of such a boat.

Figure 3:
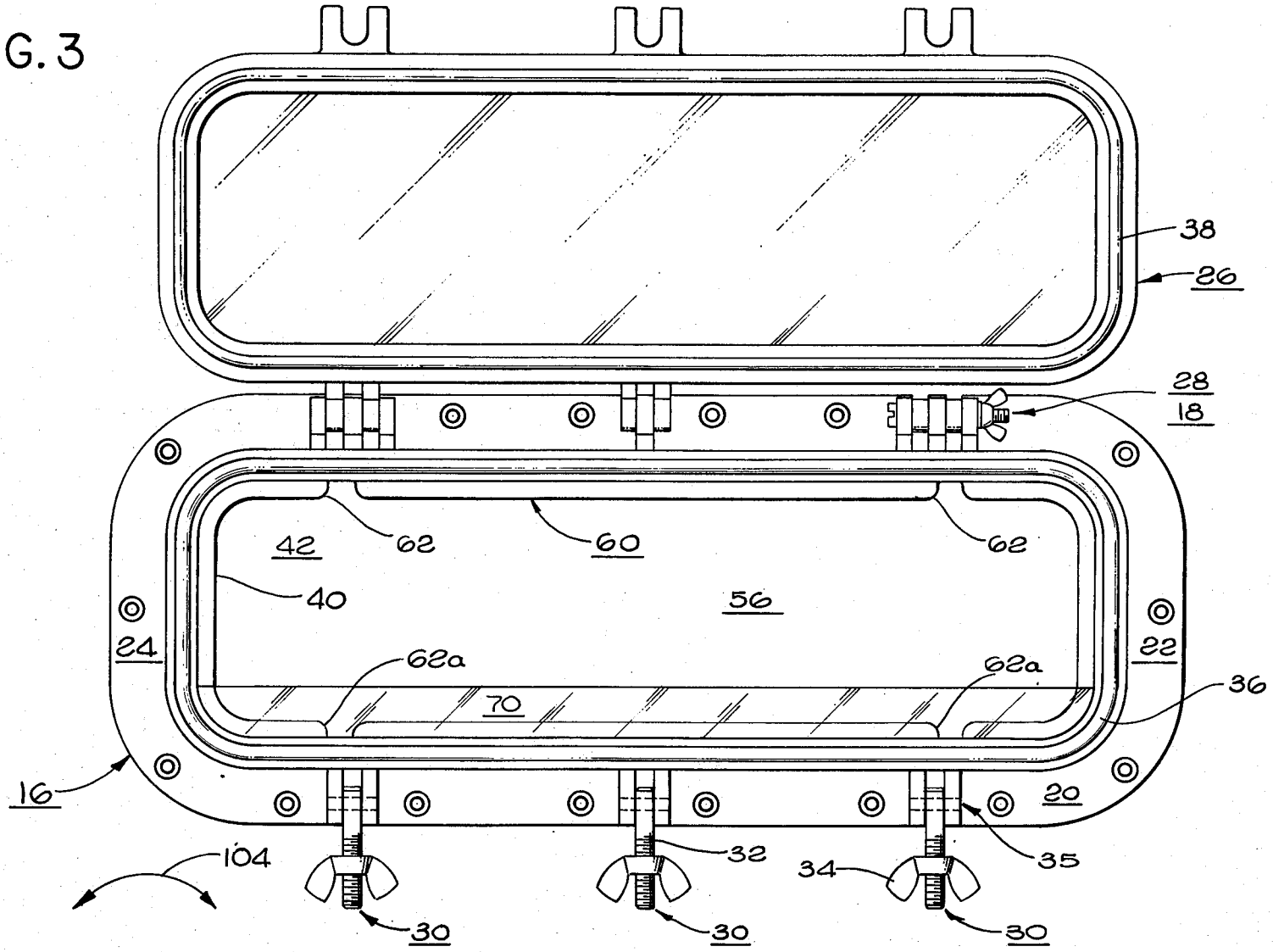
FIG. 3 is a view of the present invention from the inboard side thereof.

The embodiment 10 is provided with an interior frame means 16 having a top wall 18, a bottom wall 20 and a pair of opposed side walls 22 and 24. The interior frame means 16 is more clearly depicted in FIG. 3. A window means 26 is pivotally mounted on the upper wall 18 of the interior frame means 16 for pivotal movement about the pivot axis 28 from an open position as illustrated in FIG. 3 to a closed position where the window 26 is closely adjacent to the interior frame means 16. The wing nut and bolt 29 may be utilized to clamp the window 26 in any desired position between the open and closed positions thereof. A plurality of pivotally mounted securing means 30 are pivotally mounted on the lower wall 20 of the interior frame means 16 and, in the embodiment 10 are comprised of pivotally mounted bolt means 32 having wing nuts 34 thereon. The securing means 30 are pivotable about an axis 35 which, in embodiment 10 is substantially parallel to the axis 28.

The securing means 30 are utilized to hold the window 26 in water tight sealing relationship to the interior frame means 16 and to provide such a water tight sealing relationship the interior frame means 16 is provided with a gasket 36 extending therearound and the window means 26 is provided with a raised lip 38 for engaging the gasket 36 for the condition of the window means 26 in the closed position.

The interior frame means 16 is provided with interior walls 40 defining an apperture 42 therethrough.

A through hull fitting generally designated 44 is coupled to the interior frame means 16 and, in preferred embodiments of the present invention is unitarily formed therewith. The through hull fitting 44 is provided with a top wall 46, a bottom wall 48 and a pair of opposed side walls 50 and 52 which are aligned with their respective counterparts in the interior frame means 16. The through hull fitting 44 is also provided with first walls 54 defining an apperture 56 therethrough and the apperture 56 is aligned with the apperture 42 in the interior frame means 16. A screen bracket means 60 is coupled to the through hull fitting 44 on the first walls 54 thereof to define an upstanding rim extending around the apperture 56. The screen bracket means 60 is also provided with apperture walls 62 defining a plurality of drain passages therethrough providing communication between the apperture 42 in the interior frame means 16 and the apperture 56 in the through hull fitting 44. The screen bracket 60 is utilized to retain a screen (not shown) in the porthole arrangement 10. The screen bracket means 60 projects a first preselected distance into the apperture 56 which distance is shown on FIG. 3 by the letter "*a*". Thus, the two drain appertures 62*a* adjacent to bottom wall 48 of the through hull fitting 44 provide communication between the bottom wall 20 of the interior frame means 16 and the bottom wall 48 of the through hull fitting 44.

A transparent rain shield means 70 is coupled to the interior surface 16' of the interior frame means 16 and is spaced a second preselected distance indicated by the letter "*b*" from the screen bracket means 60. The transparent rain shield means 70 extends upwardly into the apperture 42 from the bottom wall 40 of the interior frame means 16 a third preselected distance indicated by the letter "*c*". The distance indicated by the letter "*c*" is greater than the distance indicated by the letter "*a*".

A U-shaped channel means 72 comprising a pair of U-shaped channels 74 and 76 are coupled to the lower surface 48 of the through hull fitting 44 and define a generally U-shaped channel 78 extending below the bottom wall 48 of the through hull fitting 44.

A first water passage means 80 extends through the bottom wall 48 of the through hull fitting 44 and communicates with the channel 78. A second water passage means 82 is provided in the bottom wall 40 of the interior frame means 16 between the rain shield 70 and the screen bracket 60 and communicates with the first water passage 80 and the channel 78. Preferably, the U-shaped channel 74 is positioned in regions adjacent the side wall 50 of the through hull fitting 44 and the U-shaped channel 76 is positioned in regions adjacent the side wall 52 of the through hull fitting 44.

A backup flange means 90 is positionable around the through hull fitting 44 on the external side of the hull 14 of the boat 12. A plurality of attachment means such as bolts 92 extend through the backup flange 90 and through the interior frame means 16 for securing the porthole arrangement 10 to the boat 12.

It will be appreciated that many other attachment means may be selected for desired applications. For example, the porthole 10 may be bonded by, for example, an epoxy or a resin to the boat hull 14; it may be secured by sheet metal screws, or the like. Similarly, the backup flange 90 may be secured to the hull 14 independently of the interior frame means 16.

The functional applicability of the structural arrangement of the porthole 10 is readily apparent from the above description and accompanying drawing. Thus, the rain shield 70 prevents the splash up of water from rain which may be impinging upon the boat 12 in the direction indicated by the arrow 100 in FIG. 4. Further, depending upon the thickness of the hull 14, the rain shield 12 may also prevent the direct impingement of rain in the general direction of the arrow 100 from entering the interior 12' of the boat 12. For the condition of the boat 12 rolling in the dire-tions indicated by the arrow 102 on FIG. 4, the functional utilization of the rain shield 70 not only prevents splash up of the rain from entering the interior 12' but also apray to which the boat 12 may be subjected. Thus, the window 26 may be maintained in its open position, as illustrated in FIG. 3, through a wider range of roll angles during rain storms and/or rough seas than has heretofore been allowed with prior art portholes.

The drain apperture walls 62 and in particular 62*a* provide communication between the apperture 42 in the interior frame means 16 and the apperture 56 in the through hull fitting 44 to allow the free flow of water therebetween.

Figure 2:
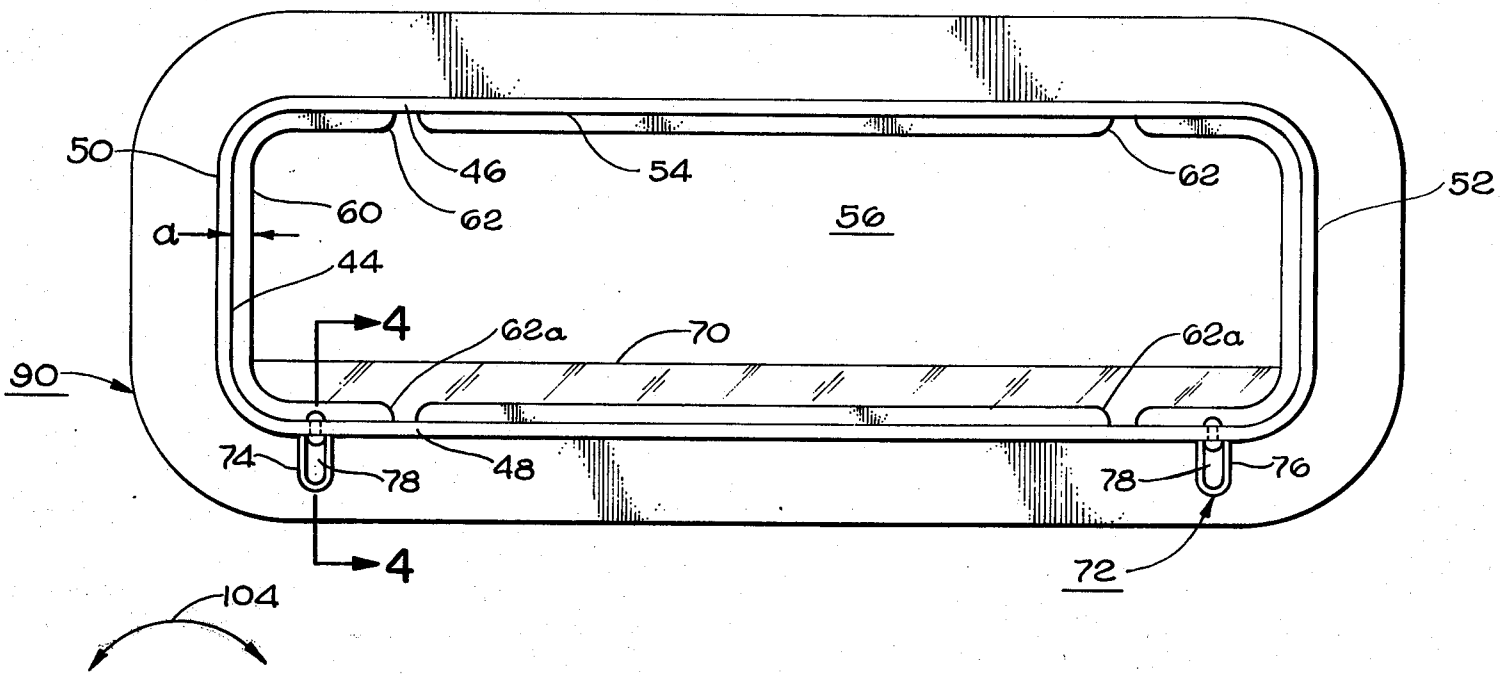
FIG. 2 is a view of the present invention from the outboard side thereof.

The water passage means 80 and 82 communicating with the channel 78 allows the free flow of water into the channel 78 and prevents the accumulation of water along the lower wall 48 of the through hull fitting 44 or the lower wall 40 of the interior frame means 16. The U-shaped channels 74 and 76 are preferably in regions adjacent to the side walls 50 and 52 of the through hull fitting 44 so that when the boat 12 is subjected to a pitching motion, as indicated by the arrow 104 in FIGS. 2 and 3, water will not build up, for example, in regions between the rain shield 70 and screen bracket 60 but will drain therefrom to the channel 78 since it is disposed vertically lower and gravity provides the necessary drain flow of the water.

As noted above, the present invention may be advantageously utilized in any structure to provide the advantages set forth. Further, the same basic structure of the porthole 10 may be so utilized regardless of the orientation, with respect to the vertical, of the structure.

FIGS. 5 and 6 illustrate an embodiment, generally designated 110, of a porthole arrangement 10', which is generally similar to the porthole arrangement 10, as may be installed on a cabin wall 112 which is upwardly slanted with respect to the vertical indicated by the dotten line 116. In the embodiment 110 there is provided a first tube means 118 extending through the aperture 82 in the bottom wall 40 of the interior frame 16, through the channel 78, through an aperture 120 in backup flange 92 and has a discharge end 118*a* adjacent to walls 112 at a position spaced vertically below the inlet end 118*b* thereof. Thus, water may drain from regions between the screen bracket 60 and rain shield 70 through first tube 118 to prevent accumulation of water therebetween. Similarly, if the rain shield 70 is omitted, as it may be in some embodiments of the present invention, tube 118 allows drainage of water from the region between the window 26 (not shown in FIG. 5) and rain shield 60.

A second tube means 122 may be provided adjacent the interior end 78' of channel 78 along the bottom thereof and through the aperture 120 in backup flange 92 to provide an outlet end 122*a* vertically spaced below the inlet end 122*b* thereof. Tube means 122 drains the channel 78 of accumulated water therein once syphon action commences. Such syphon action may be started, for example, by rolling motion of the boat having cabin 112 thereon.

Figure 7:
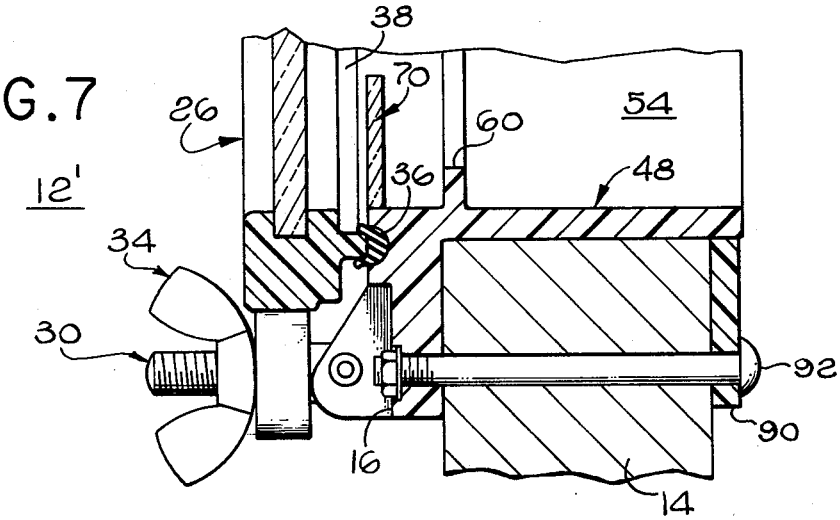
FIG. 7 is a sectional view similar to FIG. 4 showing the window in a closed position.

FIG. 7 is a view similar to FIG. 4 but showing the window of the porthole in a closed position wherein the rim 38 is in sealing engagement with the gasket 36.

From the above it is apparent that there has been provided an improved porthole arrangement. Those skilled in the art may find many variations and adaptations thereof and the appended claims are intended to cover all such variations and adaptations falling within the true scope and spirit of the invention.

I claim:

1. In a porthole arrangement for mounting on the wall of a vehicle the improvement comprising, in combination:

an interior frame means, having top, bottom and opposed side walls;

a fitting means having top, bottom and opposed side walls coupled to said interior frame means and extending through the wall of the vehicle from the interior to regions exterior thereof and each of said interior frame means and said fitting means having first walls defining a aligned aperture therethrough;

screen bracket means comprising an upstanding rim means coupled to said first walls of said fitting means and extending therearound and into said aperture therein a first preselected distance and spaced from said interior frame means a second preselected distance;

a transparent rain shield means coupled to said interior frame means along said bottom wall thereof and projecting a third preselected distance into said aperture therein, and said third preselected distance greater than said first preselected distance;

said screen bracket means having drain aperture walls therethrough defining water drain means along said bottom wall of said fitting means and providing communication between said bottom wall of said fitting means and said bottom wall of said interior frame means;

U-shaped channel means coupled to said bottom wall of said fitting and extending therebelow and having walls defining a U-shaped channel;

first water passage means extending through said bottom wall of said fitting means and communicating with said U-shaped channel; and second water passage means extending through said bottom wall of said interior frame means and communicating with said U-shaped channel.

2. The arrangement defined in claim 1 wherein:

said second water passage means extends through said bottom wall of said interior frame means in regions intermediate said rain shield means and said screen bracket means.

3. The arrangement defined in claim 2 wherein:

said first water passage means extends through said bottom wall of said fitting means in regions adjacent said screen bracket means.

4. The arrangement defined in claim 3 wherein:

said U-shaped channel means comprises a pair of spaced apart U-shaped channels.

5. The arrangement defined in claim 4 wherein:

a first of said pair of U-shaped channels is adjacent a first of said opposed side walls and the second of said pair of U-shaped channels is adjacent the other of said opposed side walls.

6. The arrangement defined in claim 5 wherein:

said bottom walls of said interior frame means and said fitting means are spaced from said top walls thereof by approximately 4 inches.

7. The arrangement defined in claim 6 wherein:

said third preselected distance is approximately seven-eighth inches; and said second and said first preselected distances are approximately one-fourth inch.

8. The arrangement defined in claim 3 and further comprising:

window means pivotally mounted on said interior frame means on said top wall thereof for movement between an open position and a closed position, and securing means mounted on said bottom wall of said interior frame for securing said window means in said closed position thereof.

9. The arrangement defined in claim 8 and further comprising:

water tight gasket means coupled to said interior frame means and extending around said aperture therethrough for providing a water tight sealing relationship to said window means for the condition of said window means in said closed position.

10. The arrangement defined in claim 9 and further comprising:

back-up flange means extending around said fitting means on the exterior of the wall;

bolt mean extending through said back-up flange means, through the wall and through said interior frame means for securing said interior frame means and said fitting means to the wall.

11. The arrangement defined in claim 2 and further comprising:

first tube means extending through said second water passage means, through said U-shaped channel to regions external the wall.

12. The arrangement defined in claim 3 and further comprising:

first tube means extending through said second water passage means, through said U-shaped channel to regions external the wall; and second tube means extending through said first water passage, through said U-shaped channel to regions external the wall.

13. The arrangement defined in claim 12 wherein:

each of said first and said second tube means has an inlet end and a discharge end and said discharge ends of each of said first and second tube means spaced vertically below said inlet ends of said first and second tube means, respectively.

14. In a porthole arrangement for mounting on the wall of a vehicle the improvement comprising, in combination:

an interior frame means, having top, bottom and opposed side walls;

a fitting means having top, bottom and opposed side walls coupled to said interior frame means and extending through the wall of the vehicle from the interior to regions exterior thereof and each of said interior frame means and said fitting means having first walls defining a aligned aperture therethrough;

screen bracket means comprising an upstanding rim means coupled to said first walls of said fitting means and extending therearound and into said aperture therein a first preselected distance and spaced from said interior frame means a second preselected distance;

said screen bracket means having drain aperture walls therethrough defining water drain means along said bottom wall of said fitting means and providing communication between said bottom wall of said fitting means and said bottom wall of said interior frame means;

U-shaped channel means coupled to said bottom wall of said fitting and extending therebelow and having walls defining a U-shaped channel;

first water passage means extending through said bottom wall of said fitting means and communicating with said U-shaped channel; and second water passage means extending through said bottom wall of said interior frame means and communicating with said U-shaped channel;

first tube means extending through said second water passage means, through said U-shaped channel to regions external the wall.

15. The arrangement defined in claim 14 wherein:

second tube means extending through said first water passage, through said U-shaped channel to regions external the wall.

16. The arrangement defined in claim 15 wherein: each of said first and said second tube means has an inlet end and a discharge end and said discharge ends of each of said first and second tube means spaced vertically below said inlet ends of said first and second tube means, respectively.

* * * * *